US006161606A

United States Patent [19]

Wegner et al.

[11] Patent Number: 6,161,606

[45] Date of Patent: Dec. 19, 2000

[54] HURRICANE STRUT FOR GARAGE DOORS

[76] Inventors: David K. Wegner, 30679 S. Hill Rd., New Hudson, Mich. 48165; Brian A. Jones, 14909 Patterson, Shelby Township, Mich. 48315

[21] Appl. No.: 09/123,590

[22] Filed: Jul. 28, 1998

[51] Int. Cl.[7] ..... E05D 15/16

[52] U.S. Cl. ..... 160/229.1; 160/201

[58] Field of Search ..... 160/201, 229.1, 160/232, 207; 52/291, 739.1, 264, 236.3

[56] References Cited

U.S. PATENT DOCUMENTS

| | | | |
|---|---|---|---|
| D. 375,573 | 11/1996 | Andres . | |
| 2,678,689 | 5/1954 | McKee et al. | 160/201 |
| 2,966,212 | 12/1960 | Fimbel | 160/201 X |
| 3,443,625 | 5/1969 | Moser et al. . | |
| 3,608,613 | 9/1971 | Halliwell | 160/201 X |
| 3,891,021 | 6/1975 | Geoffrey | 160/201 X |
| 4,378,043 | 3/1983 | Sorenson | 160/201 X |
| 4,921,033 | 5/1990 | Finch et al. . | |
| 4,934,439 | 6/1990 | Martin | 160/201 |
| 4,974,658 | 12/1990 | Komatsu et al. . | |
| 5,445,207 | 8/1995 | Romanelli et al. . | |
| 5,588,270 | 12/1996 | Keating | 160/201 X |
| 5,706,877 | 1/1998 | Grisham et al. | 160/201 |
| 5,732,758 | 3/1998 | Marko | 160/201 |
| 5,749,407 | 5/1998 | Brenner et al. | 160/201 X |

*Primary Examiner*—David M. Purol
*Attorney, Agent, or Firm*—Young & Basile, P.C.

[57] ABSTRACT

An overhead garage door having a plurality of pivotally interconnected panel structures and a reinforcing strut to allow use of the door in hurricane prone environments. The reinforcing strut extends the full width of the door across the inside rear face of the door and includes widely spaced straight upper and lower horizontal legs extending rearwardly from the rear faces of the stiles of the panel structure joined by a semi-circular top section extending in a continuous convex curvilinear sweep between the two legs. The radius of curvature of the semi-circular section is relatively large compared to the length of the upper and lower leg sections, giving the beam a wide stance. For example, the radius of curvature of the top section may be approximately 1.25" and the leg section length may be between about 2.5" and 5". The strut may be roll-formed or shaped by bending flat stock on, for example, a press brake.

15 Claims, 3 Drawing Sheets

HURRICANE STRUT FOR GARAGE DOORS

FIELD OF THE INVENTION

This invention relates to overhead garage doors and more particularly to a reinforcing strut which effectively resists deflection of such doors due to wind loads.

BACKGROUND OF THE INVENTION

Overhead doors are widely employed as garage closures because they achieve the desired result with minimal loss of floor space. It is desired to construct such doors from relatively lightweight materials such as fiberglass and sheet metal panels to reduce the difficulty involved in raising and lowering the door. However, even relatively light weight doors can weigh in excess of three hundred pounds.

A particular problem with large area doors arises in geographic areas such as so-called "hurricane zones" which are subject to high wind conditions. The wind load on a double width garage door can cause the door to flex inwardly at the center and sufficient flexing can cause permanent deformation and, at the extreme, catastrophic failure.

Various constructions have been proposed to address the need for reinforcement in sectional garage and warehouse doors. Examples of such reinforcing constructions are shown, for example, in U.S. Pat. No. 3,443,625 "Reinforced Collapsible Door", issued May 13, 1969 to Moser et al. and U.S. Pat. No. 5,445,207, "Reinforced Collapsible Garage Door Assembly," issued Aug. 29, 1995 to Romanelli et al. as well as in U.S. Pat. No. 4,974,058 "Sheet Shutter" issued Dec. 4, 1990 to Komatsu et al and which discloses a roll-up warehouse door. Although the latter patent proposes the use of pipes as reinforcement members, reinforcement of a garage door is more typically achieved through the addition of long horizontal interior struts which are roll shaped into a hollow, rectangular beam shape and attached to the interior, vertical door stiles by sheet metal screws. These struts generally exhibit small radius corners which act as stress concentrators. Moreover, they are commonly used in multiples per door panel and can add considerably to the overall weight of the door.

SUMMARY OF THE INVENTION

This invention is directed to the provision of an improved reinforcing beam or strut for use in combination with overhead garage doors which (a) eliminates stress concentrators, (b) is exceptionally strong and (c) adds less weight to a reinforced door than prior art struts.

The present invention relates to an overhead garage door of the type comprising a plurality of hingedly interconnected horizontal door panel structures and a plurality of lateral reinforcing beams or struts secured to the rear, i.e., inside faces of at least certain of the panel structures and extending substantially across the width of the door.

According to the invention, each reinforcing strut, in cross-section, includes substantially straight parallel and widely spaced legs joined by a large-radius curved section. This strut construction provides greater reinforcement strength for a given size and weight of material and thereby minimizes the number of beams and the total weight of the beams required to provide the desired reinforcing effect.

In the preferred form, the joining section is of semi-circular configuration. Moreover, the radius of curvature of the semi-circular section is at least one quarter and preferably on the order of one-half of the leg height. This specific dimensional relationship has been found to minimize stress concentrations in the strut structure and allow the use of relatively thin sheet material to form the strut structure. In the disclosed embodiment of the invention the radius of curvature of the semi-circular section is approximately 1.25" and the leg height can vary from about 2.5" to 5". The "leg height" is the distance from the foot flange to the center of curvature of the top section; the total height is to sum of the leg height and the radius of curvature.

In the illustrated embodiment, the strut member further includes spaced lateral foot flanges such that the struts may be readily secured to a door stile or set of stiles with sheet metal screws.

In the illustrated embodiment of the invention, each door panel structure includes an exterior front panel and a plurality of vertical stile members fixedly secured at laterally spaced locations to a rear face of the panel; the struts being secured to rear faces of the stiles. Because of the great strength of the struts, only a single strut need often be provided for each panel structure. This significantly reduces the weight of the door with attendant savings in construction costs, installation costs, and shipping costs and reduces the power requirements of the automatic door opener used with the door.

BRIEF DESCRIPTION OF AN ILLUSTRATIVE EMBODIMENT

DETAILED DESCRIPTION OF THE PREFERRED EMBODIMENT

Figure 1:
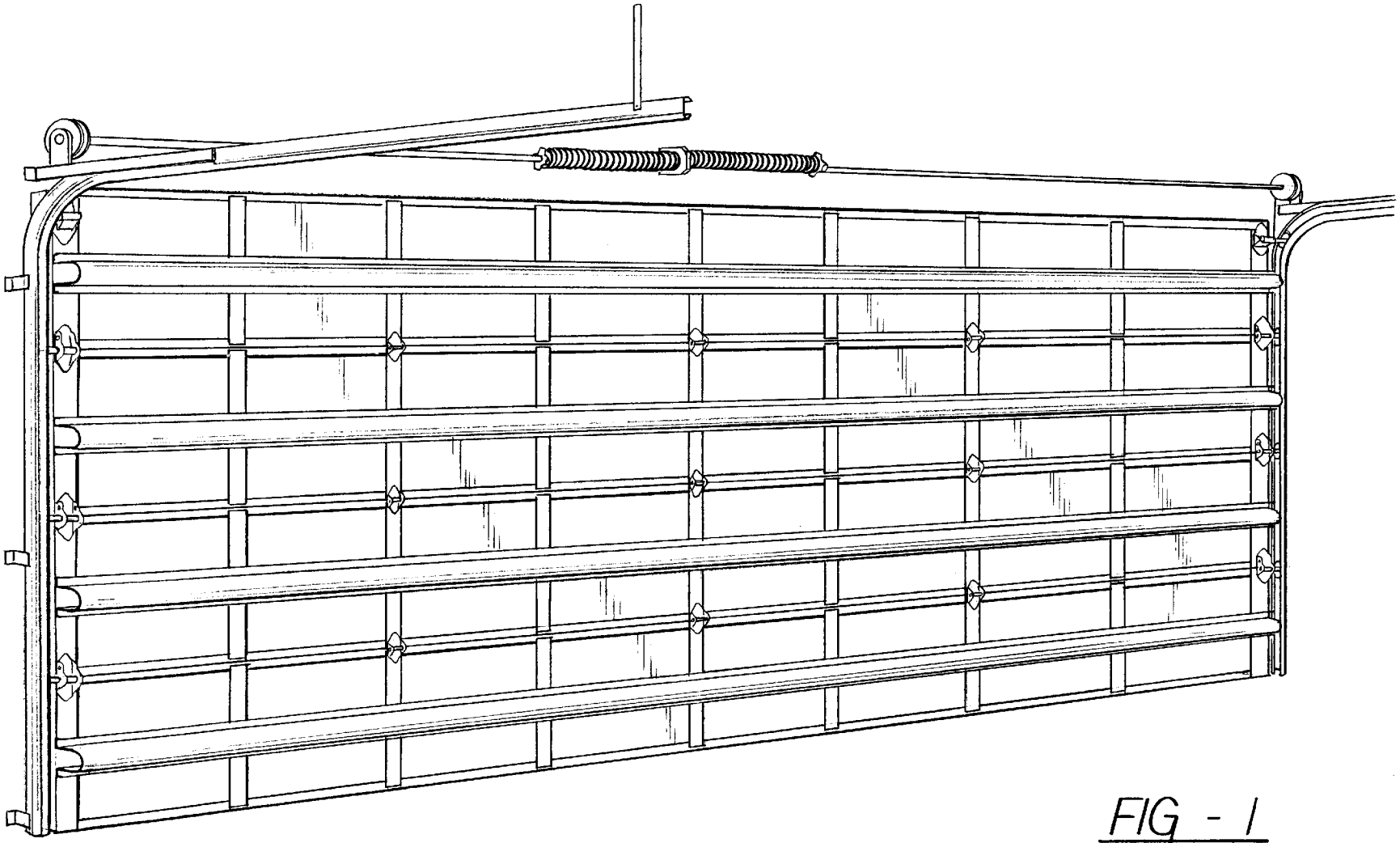
FIG. 1 is a perspective view of an overhead garage door with struts designed according to the invention.

The double width, multiple-panel overhead garage door 10 seen in FIG. 1 is designed to be mounted over a suitable door opening and is guided in known manner for up and down movement by rollers 12 operating in curved tracks 14 flanking the opposite edges of the door opening.

Door 10 includes a plurality of horizontally extending articulated door panel structures 16 pivotally connected along their upper and lower edges. Each structure 16 includes an exterior front panel 24 extending the width of the door, vertical edge stiles 26 fixedly secured to the rear face of the panel proximate each lateral edge of the panel, and a plurality of intermediate vertical stiles 28 fixedly secured to the rear face of the panel at laterally spaced locations between the edge stiles. Panels 24 may be formed, for example, of sheet metal or vinyl. The respective edge stiles 26 are vertically aligned and are hinged as seen at 30 to allow articulation of the panel structures 16 as the door moves between its vertical closed position and a horizontal open position. The respective intermediate stiles are joined by hinges 32.

Figure 4:
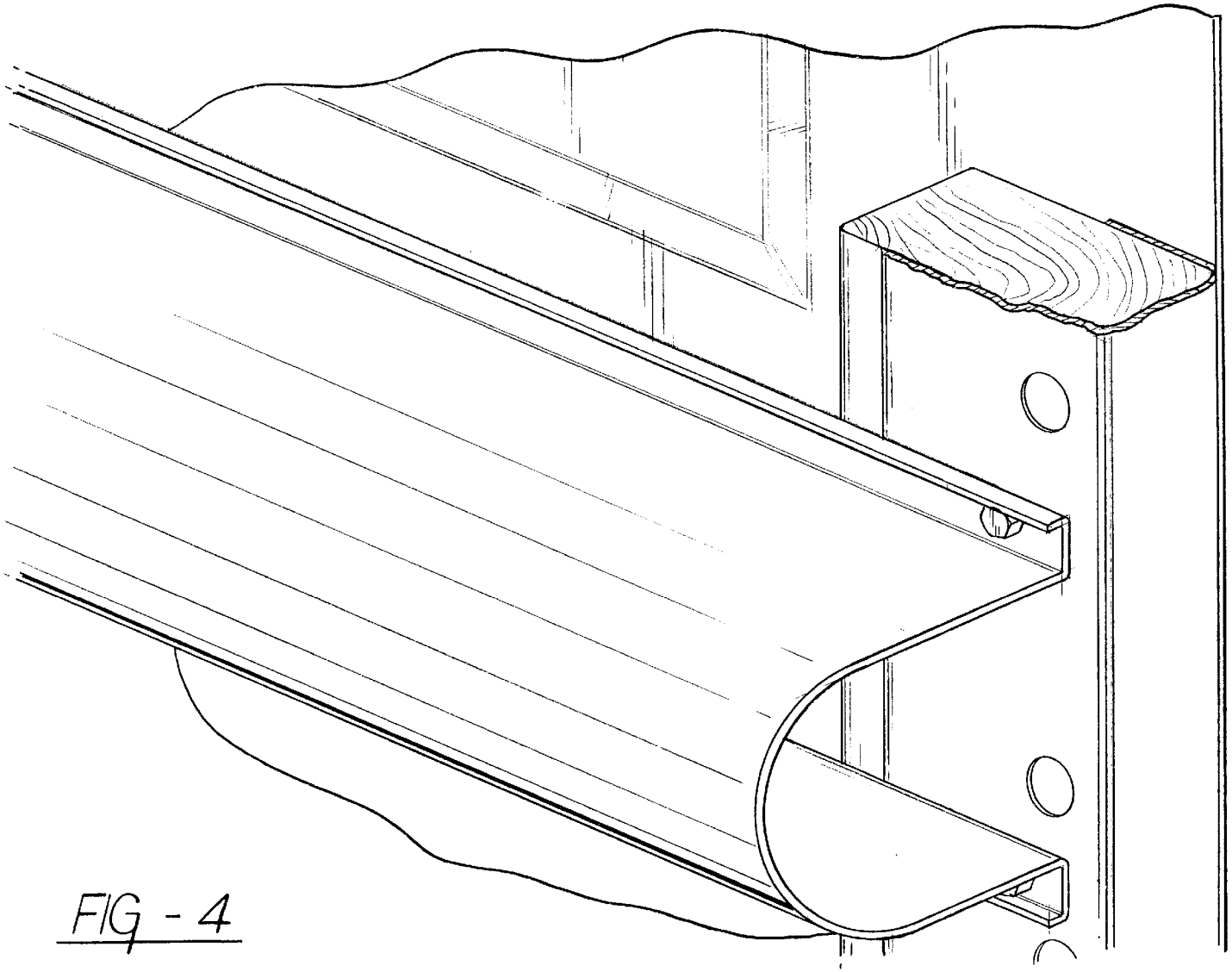
FIG. 4 is a fragmentary perspective view of a portion of the garage door.

Each edge stile 26 (FIG. 4) is constituted in this instance as a composite vertical beam structure including a 2"×4" inch wood beam 34 held by a U-shaped metal strip 36. The wood beam 34 is not essential; it can be replaced with hollow plastic or metal structures or eliminated entirely where its added strength is not called for.

Figure 2:
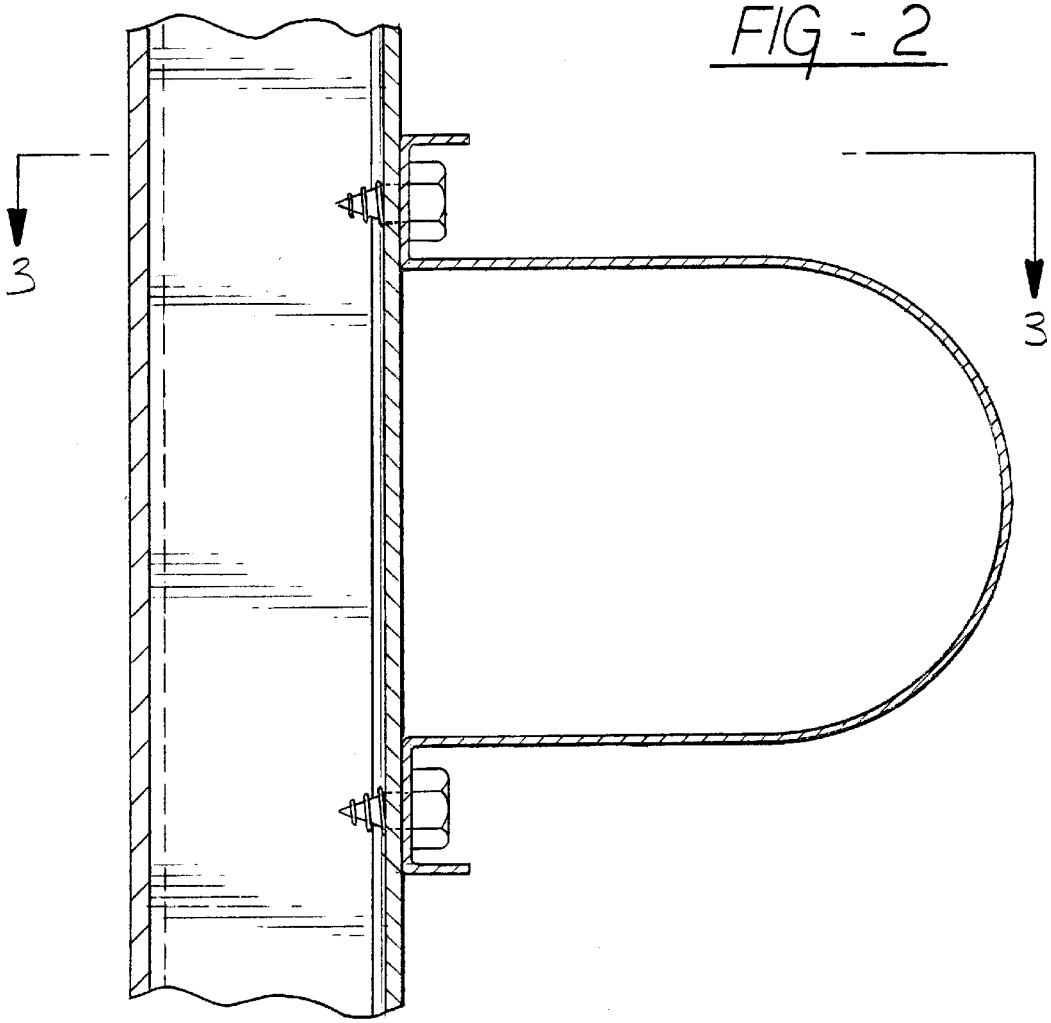
FIG. 2 is a cross-sectional view of a section of the garage door of FIG. 1.
Figure 3:
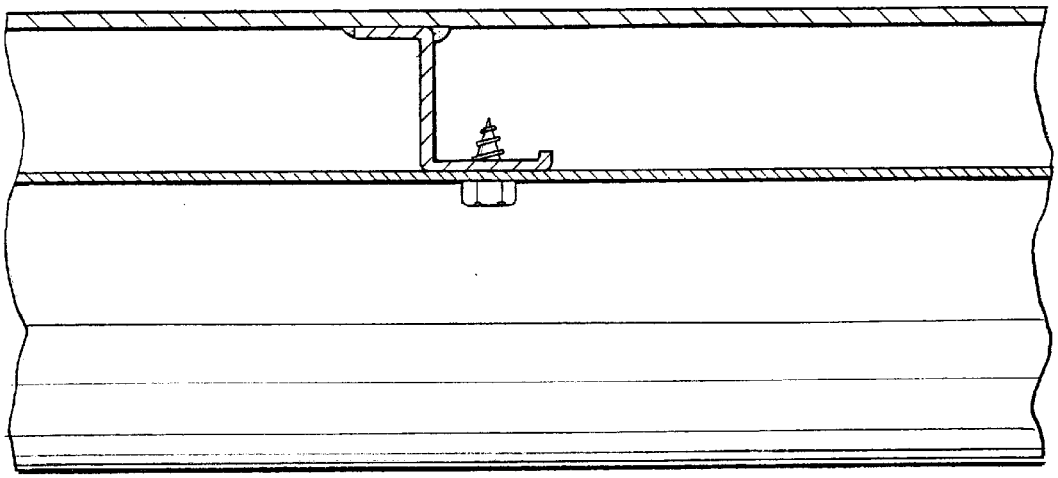
FIG. 3 is a cross-sectional view taken on line 3—3 of FIG. 2.

Each intermediate stile 28 (FIGS. 2, 3, 4) is preferably formed of a metallic material and has a Z-configuration in cross-section. Each stile 28 includes a main body web portion 28*a*, an outboard flange portion 28*b* extending at right angles to web portion 28*a*, and an inboard flange portion 28*c* extending at right angles to web portion 28*a* in an opposite direction from outboard flange portion 28*a*. Intermediate stiles 28 are secured in vertical fashion to the rear face of the respective panel 24 by adhesive 38 interposed between the outboard flange portion 28*b* and the rear face of the panel.

Door 10 further includes a plurality of hurricane struts 40 extending across the rear face of the door to reinforce the door against bending or buckling. Specifically, a strut 10 extends across the rear face of each panel structure 16, generally centrally of the panel structure, and is secured to the rear faces of the panel structure stiles.

Each strut 40 is constituted as a thin gauge steel structure and, in cross-section, includes substantially straight upper and lower horizontal leg sections 40*a* extending rearwardly from the rear inside faces of the stile members, from a front leg section edge 40*b* proximate the stile members to a rear leg section edge 40*c*, and a rear section 40*d* extending in a continuous convex curvilinear sweep from the rear edge of upper leg section 40*a* to the rear edge of lower leg section 40*a*. The leg sections 40*a* are essentially parallel and the top curvilinear section has a semi-circular cross-sectional configuration. The radius of curvature of the top section 40*d* is preferably at least one-half as great as the leg section dimension measured from a leg section front edge 40*b* to a leg section rear edge 40*c* so as to give the beam a relatively wide stance. For example, the radius of curvature of the top section may be approximately 1.5" and the leg section dimension may be from approximately 2.5" to 6" as described above. While a single radius, U-shape is preferred, an M-shaped strut with multiple radii is also possible.

The strut 40 may be roll-formed or created from flat stock in a press brake. Roll-forming is generally the more efficient process, but use of a press brake may be more cost effective, particularly where struts of several different dimensions are to be made.

Each strut 40 further includes an upper lateral flange section 40*e* extending upwardly from the front edge of the upper leg section and a lower lateral flange section 40*f* extending downwardly from the front edge of the lower leg section. An upper lateral reinforcing rib section 40*g* extends rearwardly from an upper edge of an upper flange 40*e* and a lower lateral reinforcing rib section 40*h* extends rearwardly from a lower edge of lower flange 40*f*. The strut is secured to the rear faces of the edge stiles 26 and to the rear faces of the intermediate stiles 28 by a plurality of metal screw fasteners 42 extending through the upper and lower flange sections 40*e*, 40*f* for engagement with the respective stile members. The fasteners 42 engaging the intermediate stiles 28 specifically engage the stile flange portions 28*c*.

The hurricane beam or strut of the invention has several important advantages. Specifically, tests have established that one hurricane strut according to the invention provides as much flexing or buckling resistance as two beams of a narrow rectangular prior art design. Satisfactory flexing resistance is provided in the context of the disclosed garage door by providing one beam in association with each panel structure rather than, as in the prior art, providing two beams of a prior art narrow rectangular design in association with each panel structure. This means that in a typical garage door formed of four panel structures and having an 18' width, four beam structures having a total length of 72', are eliminated, representing a significant reduction in the suspended weight of the door. This significant savings in beam material provides a significant savings in the cost of manufacturing the door; a significant savings in the shipping cost of the door; a significant potential savings in the cost, size and weight of the associated guide track and counter-balance apparatus; and a potential reduction in the size of the electric motor commonly utilized to move the door between open and closed positions. The reduced weight also greatly simplifies the installation of the door since the weight that must be handled by the installers is significantly reduced.

Whereas a preferred embodiment of the invention has been illustrated and described in detail it will be apparent that various changes may be made in the disclosed embodiment without departing from the scope or spirit of the invention.

What is claimed is:

1. An overhead door of the type comprising a plurality of horizontally extending door panel structures hingedly connected together along their upper and lower edges and a lateral reinforcing strut secured to rear faces of at least certain of the panel structures and extending substantially across the width of the door, characterized in that:

each reinforcing strut includes a pair of relatively widely spaced apart, parallel horizontal legs having a height from about 2.5" to 5.0" integrally joined by a relatively large radius, smoothly curving section of semi-circular cross-sectional configuration and having a radius of curvature at least one-quarter as great as the leg height.

2. An overhead door according to claim 1 wherein the radius of curvature of the curving section is at least one-half as great as the leg height.

3. An overhead door according to claim 2 wherein the radius of curvature of the curving section is at least 1".

4. An overhead door according to claim 3 wherein the radius of curvature of the curving section is approximately 1.25" and the leg section dimension is between approximately 2.5" and 5".

5. An overhead door according to claim 1 wherein each strut further includes foot flanges integrally attached to the legs.

6. An overhead door according to claim 5 wherein each strut is secured to the rear faces of the respective panel structure by a plurality of fasteners extending through the foot flanges.

7. An overhead door according to claim 5 wherein each strut further includes:

an upper lateral reinforcing rib section extending rearwardly from the edge of one foot flange; and a lower lateral reinforcing rib section extending rearwardly from the edge of the other foot flange.

8. An overhead door of the type comprising a plurality of horizontally extending door panel structures pivotally connected along their upper and lower edges to form the door and each including an exterior front panel, a plurality of vertical stile members fixedly secured at laterally spaced locations to a rear face of the panel, and a lateral reinforcing strut member secured to rear faces of the stile members and extending substantially across the width of the door, characterized in that:

the reinforcing strut member, in cross-section, includes substantially straight, parallel upper and lower horizontal legs extending rearwardly from the rear faces of the stile members, from a front leg edge proximate the stile members to a rear leg edge, and an integral top section extending in a continuous convex curvilinear sweep from the upper leg to the lower leg and having a semi-circular configuration and a radius of curvature at least one-quarter as great as the height of the leg.

9. An overhead door according to claim 8 wherein the radius of curvature of the top section is at least one-half as great as the height of the leg.

10. An overhead door according to claim 9 wherein the radius of curvature of the top section is at least 1".

11. An overhead door according to claim 10 wherein the radius of curvature of the top section is approximately 1.25" and the leg height is between about 2.5" and 5".

12. An overhead door according to claim 8 wherein the strut member further includes an upper lateral flange section extending upwardly from the front edge of the upper leg and a lower lateral flange section extending downwardly from the front edge of the lower leg.

13. An overhead door according to claim 12 wherein the strut member is secured to the rear faces of the stile members by a plurality of fasteners extending through the upper and lower flange sections for engagement with the stile members.

14. An overhead door according to claim 12 wherein the strut member further includes:

an upper lateral reinforcing rib section extending rearwardly from an upper edge of the upper flange; and a lower lateral reinforcing rib section extending rearwardly from a lower edge of the lower flange.

15. An overhead garage door of the type comprising a plurality of horizontally extending door panel structures pivotally connected along their upper and lower edges to form the garage door and each including an exterior front panel, a plurality of vertical stile members fixedly secured at laterally spaced locations to a rear face of the panel, and a hurricane strut fixedly secured to rear faces of the stile members and extending across the width of the door, characterized in that:

the hurricane strut, in cross-section, includes substantially straight upper and lower horizontal substantially parallel legs extending rearwardly from the rear faces of the stile members from a front leg section edge proximate the stile members to a rear leg section edge, and a semi-circular section extending in a continuous convex curvilinear sweep from the upper leg to the lower leg;

the radius of curvature of the semi-circular section is at least one-half as great as the leg section height;

the strut member further includes an upper lateral flange section extending upwardly from the front edge of the upper leg and a lower lateral flange section extending downwardly from the front edge of the lower leg; and the strut is secured to the rear faces of the stile members by a plurality of fasteners extending through the upper and lower flange sections for engagement with the stile members.

* * * * *